US010767882B2

(12) United States Patent
Kowald et al.

(10) Patent No.: US 10,767,882 B2
(45) Date of Patent: Sep. 8, 2020

(54) REFRIGERANT PUMP DOWN FOR AN HVAC SYSTEM

(71) Applicant: Lennox Industries Inc., Richardson, TX (US)

(72) Inventors: Glenn William Kowald, Carrollton, TX (US); Eric Berg, The Colony, TX (US); Rakesh Goel, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 87 days.

(21) Appl. No.: 16/163,260

(22) Filed: Oct. 17, 2018

(65) Prior Publication Data

US 2020/0124306 A1 Apr. 23, 2020

(51) Int. Cl.

| | |
|---|---|
| ***F24F 11/36*** | (2018.01) |
| ***F24F 1/26*** | (2011.01) |
| ***F25B 49/00*** | (2006.01) |
| ***F24F 11/526*** | (2018.01) |

(52) U.S. Cl.

CPC ..... *F24F 11/36* (2018.01); *F24F 1/26* (2013.01); *F24F 11/526* (2018.01); *F25B 49/005* (2013.01); *F25B 2400/12* (2013.01); *F25B 2500/22* (2013.01); *F25B 2600/2503* (2013.01)

(58) Field of Classification Search

CPC ..... F25B 49/005; F25B 2600/2503; F25B 2400/12; F25B 2500/22; F23F 1/26; F23F 11/526

See application file for complete search history.

(56) References Cited

U.S. PATENT DOCUMENTS

| | | | | |
|---|---|---|---|---|
| 10,113,763 | B2 * | 10/2018 | Ochiai | F25B 13/00 |
| 10,488,072 | B2 * | 11/2019 | Yajima | F24F 11/30 |
| 2019/0331377 | A1 * | 10/2019 | Matsuda | F24F 11/52 |
| 2019/0338971 | A1 * | 11/2019 | Yoneyama | F24F 11/77 |
| 2019/0383509 | A1 * | 12/2019 | Takagi | F25B 1/00 |
| 2020/0011560 | A1 * | 1/2020 | Minamida | F25B 1/00 |
| 2020/0049361 | A1 * | 2/2020 | Minamida | F24F 11/36 |
| 2020/0049384 | A1 * | 2/2020 | Asanuma | F25B 49/02 |

OTHER PUBLICATIONS

Goel, R. et al., "HVAC System and Method of Circulating Flammable Refrigerant," U.S. Appl. No. 16/162,934, filed Oct. 17, 2018, 30 pages.

Crawford, C. T. et al., "Systems and Methods for Pumping Down Flammable Refrigerant," U.S. Appl. No. 16/256,319, filed Jan. 24, 2019, 36 pages.

Crawford, C. T. et al., "Systems and Methods for Pumping Down Flammable Refrigerant," U.S. Appl. No. 16/256,378, filed Jan. 24, 2019, 36 pages.

* cited by examiner

*Primary Examiner* — Kun Kai Ma
(74) *Attorney, Agent, or Firm* — Baker Botts L.L.P.

(57) ABSTRACT

In one embodiment, an HVAC system includes an indoor unit having an indoor blower, an outdoor unit having a compressor and a condenser, an isolation valve coupled to the outdoor unit, and a sensor to detect a refrigerant leak. The HVAC system further includes one or more controllers operable to generate an alarm in response to the sensor detecting the refrigerant leak, operate the indoor blower in response to generating the alarm, close the isolation valve in response to generating the alarm, and operate the compressor to pump down the refrigerant to the condenser in response to generating the alarm.

23 Claims, 5 Drawing Sheets

REFRIGERANT PUMP DOWN FOR AN HVAC SYSTEM

TECHNICAL FIELD

This disclosure generally relates to a heating, ventilation, and air conditioning (HVAC) system, and more specifically to refrigerant pump down for the HVAC system.

BACKGROUND

Certain HVAC systems currently use mildly flammable refrigerant. Mildly flammable refrigerant may leak, causing unsafe concentrations of gas to be dispersed within a living environment. The unsafe concentrations of gas within the living environment may be perilous for the elderly and the sick.

SUMMARY

According to an embodiment, an HVAC system includes an indoor unit having an indoor blower, an outdoor unit having a compressor and a condenser, an isolation valve coupled to the outdoor unit, and a sensor to detect a refrigerant leak. The HVAC system further includes one or more controllers operable to generate an alarm in response to the sensor detecting the refrigerant leak, operate the indoor blower in response to generating the alarm, close the isolation valve in response to generating the alarm, and operate the compressor to pump down the refrigerant to the condenser in response to generating the alarm.

According to another embodiment, a method includes detecting, by a sensor of an HVAC system, a leak of refrigerant and generating an alarm in response to the sensor detecting the refrigerant leak. The method also includes operating an indoor blower of an indoor unit of the HVAC system in response to generating the alarm and closing an isolation valve coupled to an outdoor unit of the HVAC system in response to generating the alarm. The method further includes operating a compressor of the outdoor unit to pump down the refrigerant to a condenser of the outdoor unit in response to generating the alarm.

According to yet another embodiment, one or more computer-readable storage media embody instructions that, when executed by a processor, cause the processor to perform operations including detecting, by a sensor of an HVAC system, a leak of refrigerant and generating an alarm in response to the sensor detecting the refrigerant leak. The operations also include operating an indoor blower of an indoor unit of the HVAC system in response to generating the alarm and closing an isolation valve coupled to an outdoor unit of the HVAC system in response to generating the alarm. The operations further include operating a compressor of the outdoor unit to pump down the refrigerant to a condenser of the outdoor unit in response to generating the alarm.

Technical advantages of this disclosure may include one or more of the following. Embodiments of this disclosure may improve the overall safety of HVAC systems. For example, refrigerant (e.g., mildly flammable refrigerant) may be pumped down to an outdoor unit in response to a detected refrigerant leak. The outdoor unit contains the refrigerant, which prevents the refrigerant from accumulating in an indoor living space. Once the refrigerant is safely evacuated, the heating cycle can continue as normal. Avoiding lockout of the heating mode improves the safety of the individuals occupying the indoor living space by providing heat and reduces the probability property damage due to frozen, broken pipes. Pumping down the refrigerant to the outdoor unit in response to a sensor alarm or other indication of system leakage quickly contains and preserves the remaining refrigerant in the outdoor unit.

Embodiments of this disclosure may allow for detection of a defective sensor or false alarm. For example, pumping down the refrigerant by the outdoor compressor allows for the verification of safe refrigerant containment via a suction line pressure sensor or a pressure switch. The verification of the safe containment of the refrigerant may indicate a false alarm and/or a defective gas sensor. A false alarm or defective sensor will not lock out gas or electric heating.

Embodiments of this disclosure may pump down the refrigerant to the outdoor unit at the conclusion of each cooling cycle or in response to one or more weather conditions. For example, the refrigerant may be pumped down when the refrigerant will not be needed for an indefinite period of time (e.g., at the conclusion of a cooling season, during a cold spell, and so on). Pumping down the refrigerant may stop a refrigerant leak from occurring during the cooling off cycle and may stop refrigerant leaks at points that may not be detectable by a sensor (e.g., an expansion valve or concealed line sets).

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

To assist in understanding the present disclosure, reference is now made to the following description taken in conjunction with the accompanying drawings, in which.

DETAILED DESCRIPTION

Traditional mildly flammable HVAC systems require a gas sensor as part of the indoor equipment to detect the presence of a gas leak. Upon the detection of the gas leak, one or more modes of operation (e.g., a cooling mode and a heating mode) may be locked out until the sensor has detected that the gas concentration has dropped to safe level. When in lockout mode, a controller issues a command to discontinue operation of the cooling and/or heating cycle. Operation of the cooling and/or heating cycle will not resume until the cooling and/or heating unit is manually reset. For gas or electrical heating, a heating mode lockout can be perilous for the elderly and the sick and may create a high probability of property damage due to frozen, busted pipes. Embodiments of this disclosure provide a mildly flammable HVAC system that responds to a refrigerant leak while continuing to provide electric heat and/or gas heat.

Figure 1:
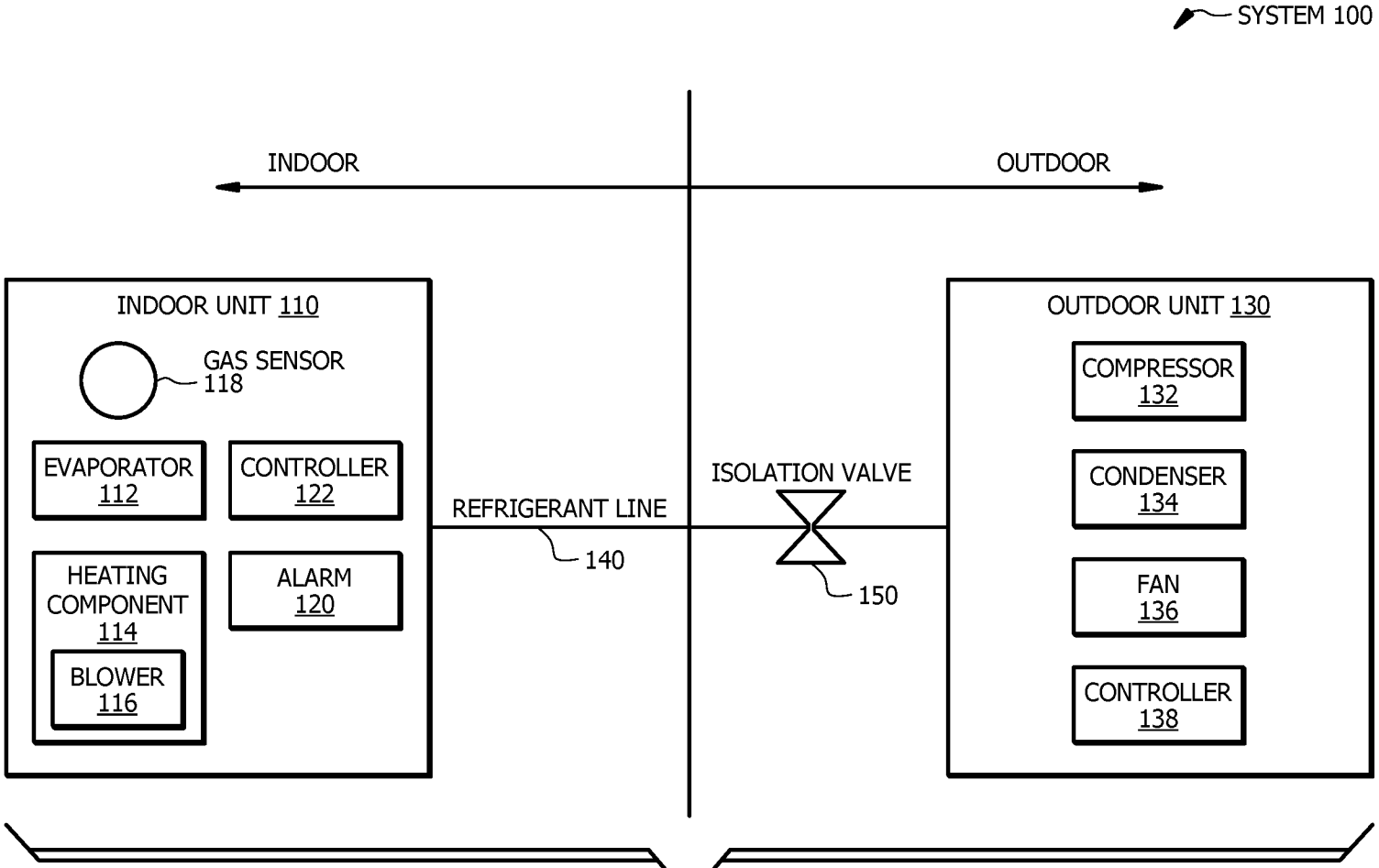
FIG. 1 illustrates an example system for pumping down refrigerant in an HVAC system.
Figure 2:
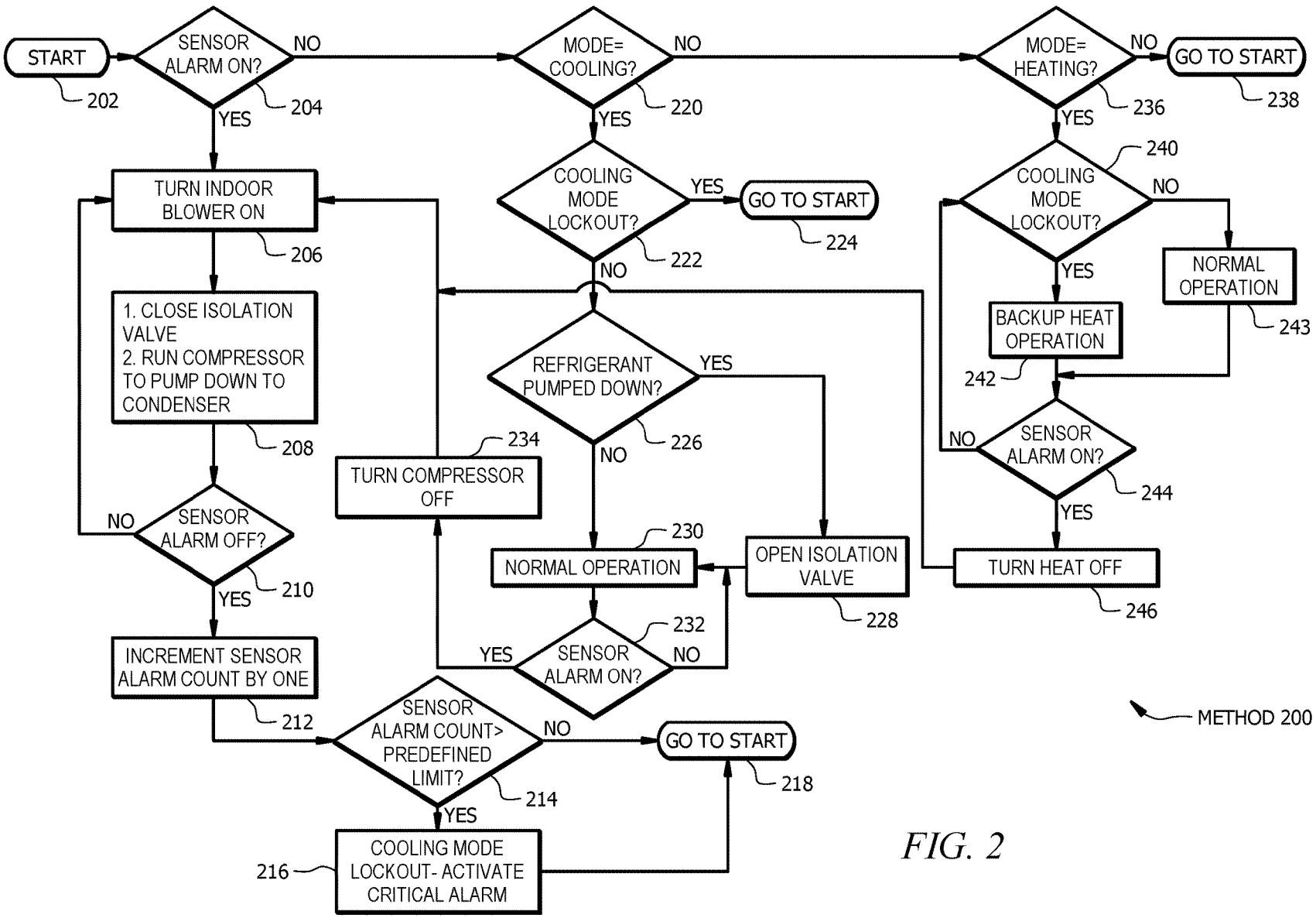
FIG. 2 illustrates an example method for pumping down refrigerant in an HVAC system in response to a sensor alarm.
Figure 3:
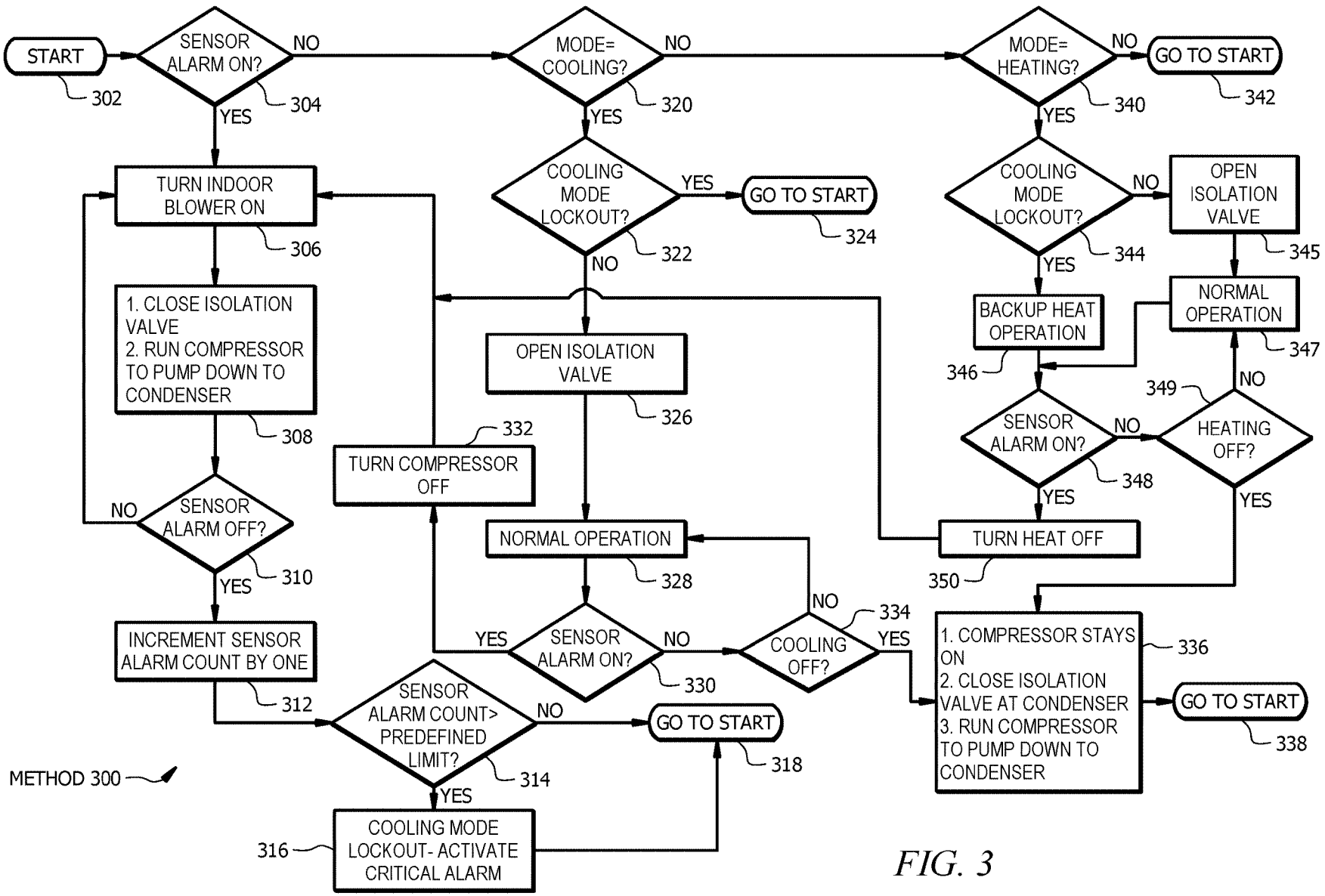
FIG. 3 illustrates an example method for pumping down refrigerant in an HVAC system in response to the conclusion of a cooling cycle.
Figure 4:
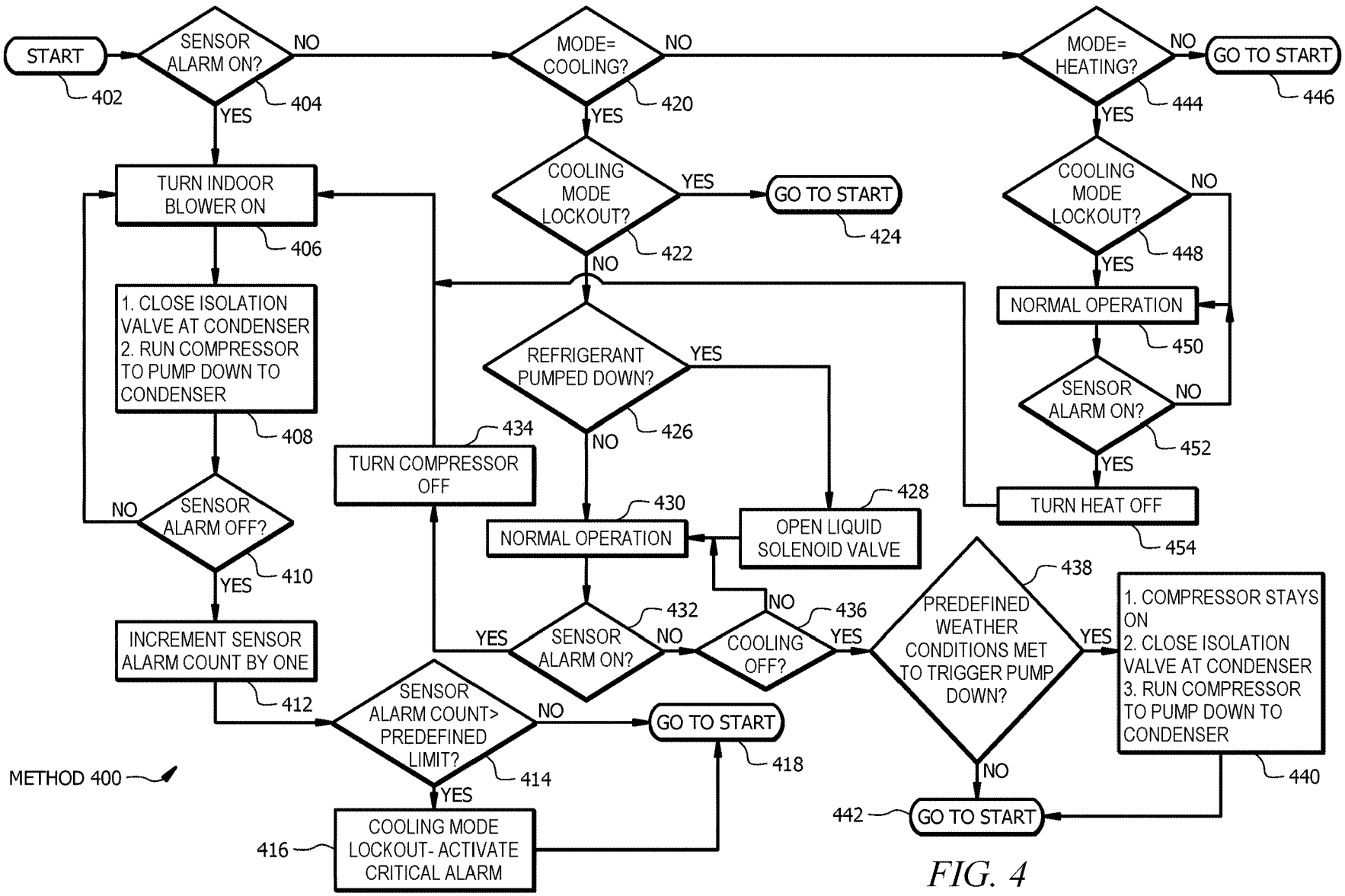
FIG. 4 illustrates an example method for pumping down refrigerant in an HVAC system in response to one or more weather conditions.
Figure 5:
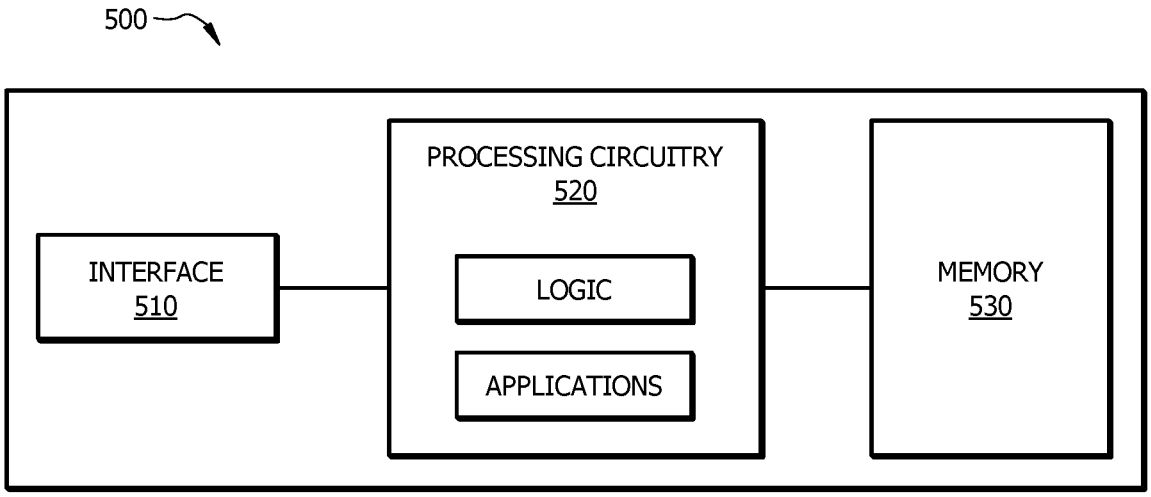
FIG. 5 illustrates an example computer system that may be used by the systems and methods described herein.

FIGS. 1 through 5 show example systems and methods for pumping down refrigerant in an HVAC system. FIG. 1 shows an example system for pumping down refrigerant in an HVAC system. FIG. 2 shows an example method for pumping down refrigerant in an HVAC system in response to a sensor alarm, FIG. 3 shows an example method for pumping down refrigerant in an HVAC system in response to the conclusion of a cooling cycle, and FIG. 4 shows an example method for pumping down refrigerant in an HVAC system in response to one or more weather conditions. FIG. 5 shows an example computer system that may be used by the systems and methods described herein.

FIG. 1 illustrates an example system 100 for pumping down refrigerant in an HVAC system. System 100 of FIG. 1 includes an indoor unit 110, an outdoor unit 130, a refrigerant line 140, and an isolation valve 150. Indoor unit 110 of system 100 includes an evaporator 112, a heating component 114, a blower 116, a gas sensor 118, an alarm 120, and a controller 122. Outdoor unit 130 includes a compressor 132, a condenser 134, one or more fans 136, and a controller 138.

System 100 is an HVAC system that pumps down refrigerant (e.g., mildly flammable refrigerant) to outdoor unit 120 in response to one or more conditions. Pumping down the refrigerant contains the refrigerant in outdoor unit 130, which prevents the refrigerant from accumulating in the indoor environment. Pumping down the refrigerant may include operating (e.g., activating) blower 116 of indoor unit 110, closing isolation valve 150 (e.g., a liquid solenoid valve), and/or operating compressor 132 of outdoor unit 130 to pump down the refrigerant to condenser 134 of outdoor unit 130. The one or more conditions that trigger the pump down may include an activation of alarm 120, a determination that a cooling cycle of system 100 has ended, and/or a weather condition (e.g., a cold spell).

Indoor unit 110 of system 100 is any HVAC unit that is located within a structure. For example, indoor unit 110 of system 100 may be located in a closet or in an attic or a basement of a residential dwelling. Heating component 114 of indoor unit 110 is any component that provides or assists in providing heat to an indoor environment (e.g., a residential dwelling). For example, heating component 114 may be a furnace or an air handling unit. Heating component 114 may include one or more blowers 116. Alternatively, blowers 116 may be separate from heating component 114. Gas sensor 118 is a sensor that detects gas within an environment. For example, gas sensor 118 may be a flammable gas sensor that detects gas resulting from a refrigerant leak in system 100. Gas sensor 118 may detect that a gas concentration of an indoor environment equals or exceeds a predetermined threshold. For example, the predetermined threshold may be a lower flammability limit (LFL) of a particular refrigerant (e.g., A2L refrigerant) as determined by one or more regulations, and gas sensor 118 may detect that the gas concentration of the indoor environment is equal to or greater than the LFL.

Alarm 120 of indoor unit 110 is any device that is operable to activate in response to one or more conditions (e.g., a detected refrigerant leak). Alarm 120 may be coupled to gas sensor 118. Alarm 120 may activate if gas sensor 118 detects a gas concentration at or above the predetermined threshold. Activation of alarm 120 may send one or more signals to controller 120 of indoor unit 110, controller 138 of outdoor unit 130, one or more other components of system 100, and/or a component outside of system 100 (e.g., a local fire department). Alarm 120 may include a critical alarm that activates if a count of the alarm (i.e., the number of times the alarm has been activated) exceeds a predetermined limit. The alarm count may be reset after a predetermined time period (e.g., an hour or a day). Controller 122 of indoor unit 120 is a component that controls operation of one or more components of system 100. For example, controller 122 may control operation of evaporator 112, heating component 114, blower 116, gas sensor 118, and/or alarm 120.

Outdoor unit 130 of system 100 is any HVAC unit that is located outdoors. For example, outdoor unit 130 of system 100 may be located in a backyard of a residential dwelling containing indoor unit 110. Compressor 132 of outdoor unit 130 is any component that is operable to pump down refrigerant to condenser 134. Condenser 134 of outdoor unit is any component that is operable to receive and store the refrigerant pumped down from compressor 132. Fan 136 of outdoor unit 130 is any component operable to blow air across condenser 134. Fan 136 includes a fan motor. Outdoor unit 130 may include a suction line pressure sensor or a pressure switch to verify safe refrigerant containment in outdoor unit 130.

Refrigerant line 140 of system 100 transfers liquid refrigerant unidirectionally from outdoor unit 130 to indoor unit 110. The refrigerant may be a mildly flammable refrigerant (e.g., an A2L refrigerant), a refrigerant with a lower flammability (e.g., A2 refrigerant), or a refrigerant with a higher flammability (e.g., an A3 refrigerant). Isolation valve 150 is coupled (e.g., physically connected) to refrigerant line 140. Isolation valve 150 is operable to prevent the refrigerant from flowing to indoor unit 110. Isolation valve 150 may be a liquid solenoid valve or an electronic expansion valve.

Although this disclosure describes and depicts system 100 including particular components arranged in a particular order, this disclosure recognizes that system 100 may include (or exclude) one or more components and the components may be arranged in any suitable order. For example, outdoor unit 130 may include a weather sensor operable to detect an outside temperature. As another example, alarm 120 may be located externally to indoor unit 110. As still another example, indoor unit 112 may be replaced with a packaged unit (e.g., an outdoor packaged unit) where evaporator 112 and blower 116 of the packaged unit are located outdoors but the ductwork associated with the packaged unit is connected to an indoor space. As another example, controllers 122 and 138 may be integrated into one component. Given the teachings herein, one skilled in the art will understand that system 100 may include additional components and devices that are not presently illustrated or discussed but are typically included in a system such as a power supply, a distributor, and so on. In one embodiment, system 100 is an HVAC system for residential use.

Although FIG. 1 illustrates a particular number of indoor units 110, outdoor units 130, refrigerant lines 140, isolation valves 150, evaporators 112, heating components 114, blowers 116, gas sensors 118, alarms 120, controllers 122, compressors 132, condensers 134, fans 136, and controllers 138, this disclosure contemplates any suitable number of indoor units 110, outdoor units 130, refrigerant lines 140, isolation valves 150, evaporators 112, heating components 114, blowers 116, gas sensors 118, alarms 120, controllers 122, compressors 132, condensers 134, fans 136, and controllers 138. For example, system 100 may include multiple indoor units 110 and outdoor units 130. As another example, indoor unit 110 may include multiple controllers (e.g., a controller for alarm 120 and a controller for heating component 114). As still another example, system 100 may include a liquid line and a vapor line isolation valve as needed to fully isolate and retain refrigerant.

In operation, gas sensor 118 of indoor unit 110 detects a refrigerant leak in an indoor environment by detecting a gas concentration above a certain threshold. Gas sensor 118 sends a signal to alarm 120 of indoor unit 110 to activate alarm 120. Upon activation of alarm 120, alarm 120 sends a signal to controller 122 to alert controller 122 of the refrigerant leak. In response to the activation of alarm 120, controller 122 initiates operation of blower 116 of indoor unit 110 to ventilate the refrigerant leak. Controller 122 closes isolation valve 150 coupled to refrigerant line 140 in response to the activation of alarm 120 to contain the refrigerant in outdoor unit 130, which prevents the refrigerant from accumulating in the indoor environment. Controller 122 initiates operation of compressor 132 of outdoor unit 130 in response to the activation of alarm 120 to pump down the refrigerant from compressor 132 to condenser 134 of outdoor unit 130, where the refrigerant is safely stored until further instruction.

As such, system 100 of FIG. 1 contains the refrigerant in outdoor unit 130 in response to a potential refrigerant leak without locking out the heating mode of the HVAC system.

FIG. 2 illustrates an example method 200 for pumping down refrigerant in response to activation of a sensor alarm in an HVAC system. Method 200 begins at step 202. At step 204, a controller (e.g., controller 122 and/or controller 138 of FIG. 1) determines whether the sensor alarm of the HVAC system (e.g., system 100 of FIG. 1) is active. The sensor alarm (e.g., alarm 120 of FIG. 1) may activate in response to receiving a signal from a gas sensor (e.g., gas sensor 118 of FIG. 1) indicating that a gas concentration in an indoor environment exceeds a certain threshold (e.g., an LFL value). The sensor alarm may send a signal to the controller indicating that the sensor alarm has been activated. If the controller determines that the sensor alarm is active, method 200 begins a pump down procedure outlined in steps 206 and 208. At step 206, the controller instructs an indoor blower (e.g., blower 116 of FIG. 1) of the HVAC system to operate. Operation of the indoor blower ventilates the indoor environment. The controller may instruct the indoor blower to continue operation if the indoor blower is currently in operation. The controller may instruct the indoor blower to activate if the indoor blower is currently deactivated.

Method 200 advances from step 206 to step 208, where the controller instructs an isolation valve (e.g., isolation valve 150 of FIG. 1) to close. The isolation valve may be a liquid solenoid valve coupled to a refrigerant line (e.g., refrigerant line 140 of FIG. 1) and/or an outdoor unit (e.g., outdoor unit 130 of FIG. 1). Closing the isolation valve assists in containing the refrigerant in the outdoor unit, which may prevent the refrigerant from accumulating in the indoor environment. The controller also instructs a compressor (e.g., compressor 132 of FIG. 1) of the outdoor unit to pump down the refrigerant to a condenser (e.g., condenser 134 of FIG. 1) of the outdoor unit until one or more predetermined pump down rules are satisfied. Pump down can occur during any mode of operation (e.g., standby or off). An example pump down rule may include initiating the pump down if the gas sensor detects a level of refrigerant exceeding a predetermined limit. Another example pump down rule may include operating the compressor until a pressure switch or a sensor indicates that a refrigerant pressure of less than 20 pounds per square inch is achieved. For example, the compressor may continue operation until a suction pressure sensor reads 20 pounds per square inch gauge (psig) or less. Once 20 psig is reached, the compressor is turned off. If a pressure switch is used, a normally closed pressure switch with a set point of 20 psig may be used. Once the pressure reaches 20 psig, the pressure switch will open and turn the compressor off. Another example pump down rule may include terminating the pump down procedure if a time to reach the pressure switch or sensor trip point is excessive (e.g., greater than a predetermined amount of time). This delay may indicate that the isolation valve has failed to close properly.

Method 200 advances from step 208 to step 210, where the controller determines whether the sensor alarm has been deactivated. If the sensor alarm is still active, method 200 continues through step 206 (continuing to operate the indoor blower) and step 208 (continuing to close the isolation valve and operate the compressor until one or more of the predetermined pump down rules are satisfied) until the sensor alarm has been deactivated. Once the controller determines at step 210 that the sensor alarm is no longer active, method 200 advances to step 212, where the controller increments a count of the sensor alarm by one. For example, if the sensor alarm was previously activated four times within a predetermined time period, the controller increments the alarm count from a count of 4 to a count of 5.

Method 200 then advances to step 214, where the controller compares the sensor alarm count to a predetermined sensor alarm count limit. The sensor alarm count limit may be any suitable integer. The sensor alarm count may be time dependent. For example, the sensor alarm count limit may reset after a predetermined amount of time (e.g., a minute, an hour, or a day). If the controller determines that the sensor alarm count is less than or equal to the predetermined sensor alarm count limit, method 200 advances to step 218, which directs method 200 back to first step 202.

If the controller determines that the sensor alarm count is greater than the predetermined sensor alarm count limit, method 200 advances to step 216, where the controller locks out the cooling mode of the HVAC system, continues the isolation of refrigerant in the outdoor unit, and activates a critical alarm. Activation of the critical alarm may generate a visual or auditory message. For example, the critical alarm may produce a loud beeping noise to alert occupants of the indoor environment to evacuate. Activation of the critical alarm may send a visual or auditory message to one or more response teams. For example, the critical alarm may automatically generate a phone call or an email message to a local fire department alerting them of the gas concentration level. Method 200 advances from step 216 to step 218, which directs method 200 back to first step 202.

At step 204, if the controller determines that the sensor alarm is not on, method 200 advances to step 220, where the controller determines whether a cooling mode of the HVAC system is turned on. If the cooling mode is turned on, method 200 advances to step 222, where the controller determines whether the cooling mode has been locked out. The cooling mode may be locked out in response to the detection of an unsafe condition or in response to exceeding the maximum allowable sensor alarm incidents. If the cooling mode has been locked out, method 200 advances to step 224, which directs method 200 back to first step 202. If the cooling mode has not been locked out, method 200 advances to step 226, where the controller determines whether the compressor pumped down the refrigerant to the outdoor unit.

If the controller determines that the refrigerant has been pumped down to the outdoor unit, method 200 advances from step 226 to step 228, where the controller instructs the HVAC system to open the isolation valve. Method 200 then advances to step 230, where the controller instructs the HVAC system to function in normal operation. In normal operation, the compressor is in operation and the indoor blower is in operation. If the controller determines that the refrigerant has not been pumped down at step 226, method 200 advances from step 226 to step 230 without opening the isolation valve. At step 230, the controller instructs the HVAC system to function in normal operation.

Method 200 advances from step 230 to step 232, where the controller determines whether the sensor alarm is active. If the sensor alarm is not active, method 200 moves back to step 230 and the HVAC system continues in normal operation. If the sensor alarm is active, method 200 moves from step 232 to step 234, where the controller instructs the compressor to discontinue operation. Method 200 then advances from step 234 to step 206 to start the pump down procedure as described above.

If the controller determines at step 220 that the cooling mode has not been turned on, method 200 advances from step 220 to step 236, where the controller determines whether a heating mode of the HVAC system is turned on. If the heating mode is not turned on, method 200 advances to step 238, which directs method 200 back to first step 202. If the heating mode is turned on, method 200 advances to step 240, where the controller determines whether the cooling mode of the HVAC system has been locked out. If the cooling mode has been locked out, the controller instructs the HVAC system to initiate a back-up heat operation. If the cooling mode has not been locked out, the controller instructs the HVAC system to function in normal operation.

Method 200 advances from steps 242 and 243 to step 244, where the controller determines whether the sensor alarm is active. If the sensor alarm is not active, method 200 moves back to step 240 to determine whether the cooling mode has been locked out. If the sensor alarm is active, method 200 moves from step 244 to step 246, where the controller instructs the HVAC system to shut down the heating mode. Method 200 then advances to step 206 to start the pump down procedure as described above.

Modifications, additions, or omissions may be made to method 200 depicted in FIG. 2. Method 200 may include more, fewer, or other steps. For example, steps 212, 214, and 216 directed to incrementing the alarm count and activating the critical alarm may be eliminated. As another example, method 200 may include an additional step of verifying containment of the refrigerant in the outdoor unit using a suction line pressure sensor or a pressure switch. Steps may also be performed in parallel or in any suitable order. For example, step 220 directed to determining whether the HVAC system is in cooling mode may occur after step 236 directed to determining whether the HVAC system is in heating mode. As another example, step 208 of the pump down procedure may occur prior to step 206 of the pump down procedure. While discussed as specific components completing the steps of method 200, any suitable component of the HVAC system may perform any step of method 200.

FIG. 3 illustrates an example method 300 for pumping down refrigerant in response to the conclusion of an HVAC system's cooling cycle. Method 300 is similar to method 200 of FIG. 2 with the exception of steps 326 through 338, which illustrate the process of pumping down the refrigerant in response to the conclusion of the cooling cycle. Method 300 begins at step 302. At step 304, a controller (e.g., controller 122 of FIG. 1) determines whether the sensor alarm of the HVAC system (e.g., system 100 of FIG. 1) is on. If the sensor alarm is on, method 300 begins a pump down procedure as outlined in steps 306 and 308. At step 306, the controller instructs an indoor blower (e.g., blower 116 of FIG. 1) of the HVAC system to operate. At step 308, the controller instructs an isolation valve (e.g., isolation valve 150 of FIG. 1) to close and a compressor (e.g., compressor 132 of FIG. 1) of the outdoor unit to pump down the refrigerant to a condenser (e.g., condenser 134 of FIG. 1) of the outdoor unit.

Method 300 advances from step 308 to step 310, where the controller determines whether the sensor alarm has been deactivated. If the sensor alarm is still active, method 300 continues through step 306 (e.g., operating the indoor blower) and step 308 (i.e., closing the isolation valve and operating the compressor until one or more predetermined pump down rules are satisfied) until the sensor alarm has been deactivated. Once the controller determines at step 310 that the sensor alarm is no longer active, method 300 advances to step 312, where the controller increments a count of the sensor alarm by one. Method 300 then advances to step 314, where the controller compares the sensor alarm count to a predetermined sensor alarm count limit. If the controller determines that the sensor alarm count is less than or equal to the predetermined sensor alarm count limit, method 300 advances to step 318, which directs method 300 back to first step 302. If the controller determines that the sensor alarm count is greater than the predetermined sensor alarm count limit, method 300 advances to step 316, where the controller locks out the cooling mode and activates a critical alarm. Method 300 then advances from step 316 to step 318, which directs method 300 back to first step 302.

At step 304, if the controller determines that the sensor alarm is not on, method 300 advances to step 320, where the controller determines whether a cooling mode of the HVAC system is turned on. If the cooling mode is on, method 300 advances to step 322, where the controller determines whether the cooling mode has been locked out. If the cooling mode has been locked out, method 300 advances to step 324, which directs method 300 back to first step 302. If the cooling mode has not been locked out, method 300 advances to step 326, where the controller instructs the HVAC system to open the isolation valve. Method 300 then advances to step 328, where the controller instructs the HVAC system to function in normal operation (i.e., the compressor and the indoor blower are both in operation).

Method 300 advances from step 328 to step 330, where the controller determines whether the sensor alarm is on. If the sensor alarm is on, method 300 moves from step 330 to step 332, where the controller instructs the compressor to discontinue operation. Method 300 then advances from step 332 to step 306 to start the pump down procedure as described above. If the sensor alarm is not on, method 300 advances from step 330 to step 334, where the controller determines whether the cooling mode of the HVAC system has been deactivated.

If the cooling mode of the HVAC system has not been deactivated at step 334, method 300 moves to step 328, where the controller instructs the HVAC system to continue normal operation. If the cooling mode of the HVAC system has been deactivated (i.e., the cooling cycle has concluded), method 300 advances to step 336, where a pump down procedure is initiated. At step 336, the controller instructs the compressor to continue operation, the isolation valve to close, and the compressor to pump down the refrigerant to the condenser until one or more predetermined pump down rules are satisfied. Method 300 then advances from step 336 to step 338, which directs method 300 back to first step 302.

If the controller determines at step 320 that the cooling mode has not been turned on, method 300 advances from step 320 to step 340, where the controller determines whether a heating mode of the HVAC system is on. If the heating mode is not on, method 300 advances to step 342, which directs method 300 back to first step 302. If the heating mode is on, method 300 advances to step 344, where the controller determines whether the cooling mode of the HVAC system has been locked out. If the cooling mode has been locked out, method 400 advances from step 344 to step 356, where the controller instructs the HVAC system to initiate a back-up heat operation. If the cooling mode has not been locked out, method 400 advances from step 344 to step 347, where the controller instructs the HVAC system to function in normal operation.

Method 300 advances from steps 346 and 347 to step 348, where the controller determines whether the sensor alarm is on. If the sensor alarm is not on, method 300 advances to step 349, where the controller determines whether the heat is off. If the heat is off, method 300 moves back to step 347 and the HVAC system continues in normal operation. If the heat is on, method 300 advances from step 349 to step 356, where the pump down procedure is initiated.

If the sensor alarm is on at step 348, method 300 advances from step 348 to step 350, where the controller instructs the HVAC system to shut down the heating mode. Method 300 then advances from step 350 to step 306 to start the pump down procedure as described above.

Modifications, additions, or omissions may be made to method 300 depicted in FIG. 3. Method 300 may include more, fewer, or other steps. For example, steps 312, 314, and 316 directed to incrementing the alarm count and activating the critical alarm may be eliminated. Steps may also be performed in parallel or in any suitable order. For example, step 320 directed to determining whether the HVAC system is in cooling mode may occur after step 340 directed to determining whether the HVAC system is in heating mode. While discussed as specific components completing the steps of method 300, any suitable component of the HVAC system may perform any step of method 300.

FIG. 4 illustrates an example method 400 for pumping down a refrigerant in response to a weather condition. Method 400 is similar to method 200 of FIG. 2 with the exception of steps 436 through 442, which illustrate the process of pumping down the refrigerant in response to one or more weather conditions. Method 400 begins at step 402. At step 404, a controller (e.g., controller 122 of FIG. 1) determines whether the sensor alarm of the HVAC system (e.g., system 100 of FIG. 1) is on. If the sensor alarm is on, method 400 begins a pump down procedure as outlined in steps 406 and 408. At step 406, the controller instructs an indoor blower (e.g., blower 116 of FIG. 1) of the HVAC system to operate. At step 408, the controller instructs an isolation valve (e.g., isolation valve 150 of FIG. 1) to close and a compressor (e.g., compressor 132 of FIG. 1) of the outdoor unit to pump down the refrigerant to a condenser (e.g., condenser 134 of FIG. 1) of the outdoor unit.

Method 400 advances from step 408 to step 410, where the controller determines whether the sensor alarm has been deactivated. If the sensor alarm is still active, method 00 continues through step 406 (e.g., operating the indoor blower) and step 408 (i.e., closing the isolation valve and operating the compressor until one or more predetermined pump down rules are satisfied) until the sensor alarm has been deactivated. Once the controller determines at step 410 that the sensor alarm is no longer active, method 400 advances to step 412, where the controller increments a count of the sensor alarm by one. Method 400 then advances to step 414, where the controller compares the sensor alarm count to a predetermined sensor alarm count limit. If the controller determines that the sensor alarm count is less than or equal to the predetermined sensor alarm count limit, method 400 advances to step 418, which directs method 400 back to first step 402. If the controller determines that the sensor alarm count is greater than the predetermined sensor alarm count limit, method 400 advances to step 416, where the controller locks out the cooling mode and activates a critical alarm. Method 400 then advances from step 416 to step 418, which directs method 400 back to first step 402.

At step 404, if the controller determines that the sensor alarm is not on, method 400 advances to step 420, where the controller determines whether a cooling mode of the HVAC system has been turned on. If the cooling mode is on, method 400 advances to step 422, where the controller determines whether the cooling mode has been locked out. If the cooling mode has been locked out, method 400 advances to step 424, which directs method 400 back to first step 402. If the cooling mode has not been locked out, method 400 advances to step 426, where the controller determines whether the refrigerant in the HVAC system has been pumped down to the condenser. If the refrigerant has been pumped down, method 400 advances from step 426 to step 428, where the controller instructs the HVAC system to open the isolation valve. Method 400 then advances to step 430, where the controller instructs the HVAC system to function in normal operation (i.e., the compressor and the indoor blower are both in operation). If the controller determines that the refrigerant has not been pumped down at step 426, method 400 advances from step 426 to step 430 without opening the isolation valve. At step 430, the controller instructs the HVAC system to function in normal operation.

Method 400 advances from step 430 to step 432, where the controller determines whether the sensor alarm is on. If the sensor alarm is on, method 400 moves from step 432 to step 434, where the controller instructs the compressor to discontinue operation. Method 400 then advances from step 434 to step 406 to start the pump down procedure as described above. If the sensor alarm is not on, method 400 advances from step 432 to step 436, where the controller determines whether the cooling mode of the HVAC system has been deactivated.

If the cooling mode of the HVAC system has not been deactivated at step 436, method 400 moves back to step 430, where the controller instructs the HVAC system to continue normal operation. If the cooling mode of the HVAC system has been deactivated (i.e., the cooling cycle has concluded), method 400 advances to step 438, where the controller determines whether one or more predetermined weather conditions are satisfied. The one or more predetermined weather conditions may include a temperature value, a humidity value, a precipitation value, an air pressure value, a wind direction value, a wind speed value, a predetermined date, a predetermined time, any combination of the aforementioned, and so on. The controller may receive the predetermined weather conditions from a database (e.g., a database stored in memory 504 of FIG. 5).

The controller may determine that a weather condition is satisfied by comparing one or more weather conditions associated with the environment of the HVAC system to one or more predetermined weather conditions. The one or more weather conditions associated with the environment of the HVAC system may include a temperature value, a humidity value, a precipitation value, an air pressure value, a wind direction value, a wind speed value, an average temperature value over a predetermined time period (e.g., a predetermined number of days), a predicted outdoor temperature (e.g., a forecasted temperature for a specific date), combination of the aforementioned, and so on. For example, the weather condition associated with the environment of the HVAC system may be a current outdoor temperature and the predetermined weather condition may be a predetermined temperature of 60 degrees Fahrenheit, and the controller may determine that the predetermined weather condition is satisfied if the outdoor temperature of the environment is less than or equal to 60 degrees Fahrenheit. The controller may receive the weather conditions associated with the environment of the HVAC system from one or more sensors (e.g., a weather sensor attached to an outdoor unit of the HVAC system).

The controller may determine that a weather condition is satisfied by comparing one or more values associated with the HVAC system to one or more predetermined weather conditions. For example, the controller may determine that a weather condition is satisfied by comparing a current date to a predetermined date (e.g., the first day of winter).

If the controller determines that the one or more predetermined weather conditions are not satisfied, method 400 advances to step 442, which directs method 400 back to first step 402. If the controller determines that the one or more predetermined weather conditions are satisfied, method 400 advances to step 440 to initiate the pump down procedure. At step 440, the controller instructs the compressor to continue operation, the isolation valve to close, and the compressor to pump down the refrigerant to the condenser until one or more predetermined pump down rules are satisfied.

If the controller determines at step 420 that the cooling mode has not been turned on, method 400 advances from step 420 to step 444, where the controller determines whether a heating mode of the HVAC system is on. If the heating mode is not on, method 400 advances to step 446, which directs method 400 back to first step 402. If the heating mode is on, method 400 advances to step 448, where the controller determines whether the cooling mode of the HVAC system has been locked out. Method 400 then advances to step 450, where the controller instructs the HVAC system to function in normal operation.

Method 400 advances from step 450 to step 452, where the controller determines whether the sensor alarm is on. If the sensor alarm is not on, method 400 moves back to step 450 and the HVAC system continues in normal operation. If the sensor alarm is on, method 400 advances from step 452 to step 454, where the controller instructs the HVAC system to turn off the heat. Method 400 then advances from step 452 to step 406 to initiate the pump down procedure as described above.

Modifications, additions, or omissions may be made to method 400 depicted in FIG. 4. Method 400 may include more, fewer, or other steps. For example, steps 412, 414, and 416 directed to incrementing the alarm count and activating the critical alarm may be eliminated. Steps may also be performed in parallel or in any suitable order. For example, step 420 directed to determining whether the HVAC system is in cooling mode may occur after step 444 directed to determining whether the HVAC system is in heating mode. While discussed as specific components completing the steps of method 400, any suitable component of the HVAC system may perform any step of method 400.

FIG. 5 shows an example computer system that may be used by the systems and methods described herein. For example, controllers 122 and 138 of FIG. 1 may include one or more interface(s) 510, processing circuitry 520, memory(ies) 530, and/or other suitable element(s). Interface 510 receives input, sends output, processes the input and/or output, and/or performs other suitable operation. Interface 510 may comprise hardware and/or software.

Processing circuitry 520 performs or manages the operations of the component. Processing circuitry 520 may include hardware and/or software. Examples of a processing circuitry include one or more computers, one or more microprocessors, one or more applications, etc. In certain embodiments, processing circuitry 520 executes logic (e.g., instructions) to perform actions (e.g., operations), such as generating output from input. The logic executed by processing circuitry 520 may be encoded in one or more tangible, non-transitory computer readable media (such as memory 530). For example, the logic may comprise a computer program, software, computer executable instructions, and/or instructions capable of being executed by a computer. In particular embodiments, the operations of the embodiments may be performed by one or more computer readable media storing, embodied with, and/or encoded with a computer program and/or having a stored and/or an encoded computer program.

Memory 530 (or memory unit) stores information. Memory 530 may comprise one or more non-transitory, tangible, computer-readable, and/or computer-executable storage media. Examples of memory 530 include computer memory (for example, RAM or ROM), mass storage media (for example, a hard disk), removable storage media (for example, a Compact Disk (CD) or a Digital Video Disk (DVD)), database and/or network storage (for example, a server), and/or other computer-readable medium.

Herein, a computer-readable non-transitory storage medium or media may include one or more semiconductor-based or other integrated circuits (ICs) (such as field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A heating, ventilation, and air conditioning (HVAC) system, comprising:

an indoor unit comprising an indoor blower;

an outdoor unit comprising a compressor and a condenser;

an isolation valve coupled to the outdoor unit;

a sensor operable to detect a leak of refrigerant; and one or more controllers operable to:

generate an alarm in response to the sensor detecting the refrigerant leak;

operate the indoor blower in response to generating the alarm;

close the isolation valve in response to generating the alarm;

operate the compressor to pump down the refrigerant to the condenser in response to generating the alarm;

determine that the alarm has been deactivated;

determine that a heating mode of the HVAC system has been initiated;

generate a second alarm in response to the sensor detecting the refrigerant leak after determining that the heating mode of the HVAC system has been initiated; and shut down the heating mode in response to generating the second alarm.

2. The HVAC system of claim 1, wherein the one or more controllers are further operable to:

increment a count of the alarm by one in response to generating the alarm;

determine that the count of the alarm is above a predetermined threshold; and generate a critical alarm in response to determining that the count of the alarm is above the predetermined threshold.

3. The HVAC system of claim 1, wherein:

the valve is a liquid solenoid valve; and the refrigerant is A2L refrigerant.

4. The HVAC system of claim 1, wherein the one or more controllers are further operable to determine whether a cooling mode of the HVAC system has been locked out, wherein a heating mode of the HVAC system is not locked out due to the detected refrigerant leak.

5. A heating, ventilation, and air conditioning (HVAC) system, comprising:

an indoor unit comprising an indoor blower;

an outdoor unit comprising a compressor and a condenser;

an isolation valve coupled to the outdoor unit;

a sensor operable to detect a leak of refrigerant; and one or more controllers operable to:

generate an alarm in response to the sensor detecting the refrigerant leak;

operate the indoor blower in response to generating the alarm;

close the isolation valve in response to generating the alarm;

operate the compressor to pump down the refrigerant to the condenser in response to generating the alarm;

determine that the alarm has been deactivated;

determine that a cooling mode of the HVAC system has been initiated;

open the isolation valve in response to determining that the cooling mode has been initiated;

determine that the cooling mode of the HVAC system has been deactivated;

determine that one or more predetermined weather conditions have been satisfied in response to determining that the cooling mode has been deactivated; and run the compressor to pump down the refrigerant to the condenser in response to determining that the one or more predetermined weather conditions have been satisfied.

6. A method, comprising:

detecting, by a sensor of a heating, ventilation, and air conditioning (HVAC) system, a leak of refrigerant;

generating an alarm in response to the sensor detecting the refrigerant leak;

operating an indoor blower of an indoor unit of the HVAC system in response to generating the alarm;

closing an isolation valve coupled to an outdoor unit of the HVAC system in response to generating the alarm;

operating a compressor of the outdoor unit to pump down the refrigerant to a condenser of the outdoor unit in response to generating the alarm;

determining that the alarm has been deactivated;

determining that a heating mode of the HVAC system has been initiated;

generating a second alarm in response to the sensor detecting the refrigerant leak after determining that the heating mode of the HVAC system has been initiated; and shutting down the heating mode in response to generating the second alarm.

7. The method of claim 6, further comprising:

incrementing a count of the alarm by one in response to generating the alarm;

determining that the count of the alarm is above a predetermined threshold; and generating a critical alarm in response to determining that the count of the alarm is above the predetermined threshold.

8. The method of claim 6, wherein:

the isolation valve is a liquid solenoid valve; and the refrigerant is A2L refrigerant.

9. The method of claim 6, further comprising determining whether a cooling mode of the HVAC system has been locked out, wherein a heating mode of the HVAC system is not locked out due to the detected refrigerant leak.

10. A method, comprising:

detecting, by a sensor of a heating, ventilation, and air conditioning (HVAC) system, a leak of refrigerant;

generating an alarm in response to the sensor detecting the refrigerant leak;

operating an indoor blower of an indoor unit of the HVAC system in response to generating the alarm;

closing an isolation valve coupled to an outdoor unit of the HVAC system in response to generating the alarm;

operating a compressor of the outdoor unit to pump down the refrigerant to a condenser of the outdoor unit in response to generating the alarm;

determining that the alarm has been deactivated;

determining that a cooling mode of the HVAC system has been initiated;

opening the isolation valve in response to determining that the cooling mode has been initiated;

determining that the cooling mode of the HVAC system has been deactivated;

determining that one or more predetermined weather conditions have been satisfied in response to determining that the cooling mode has been deactivated; and operating the compressor to pump down the refrigerant to the condenser in response to determining that the one or more predetermined weather conditions have been satisfied.

11. One or more computer-readable storage media embodying instructions that, when executed by a processor, cause the processor to perform operations comprising:

detecting, by a sensor of a heating, ventilation, and air conditioning (HVAC) system, a leak of refrigerant;

generating an alarm in response to the sensor detecting the refrigerant leak;

operating an indoor blower of an indoor unit of the HVAC system in response to generating the alarm;

closing an isolation valve coupled to an outdoor unit of the HVAC system in response to generating the alarm;

operating a compressor of the outdoor unit to pump down the refrigerant to a condenser of the outdoor unit in response to generating the alarm;

determining that the alarm has been deactivated;

determining that a heating mode of the HVAC system has been initiated;

generating a second alarm in response to the sensor detecting the refrigerant leak after determining that the heating mode of the HVAC system has been initiated; and shutting down the heating mode in response to generating the second alarm.

12. The one or more computer-readable storage media of claim 11, wherein the operations further comprise:

incrementing a count of the alarm by one in response to generating the alarm;

determining that the count of the alarm is above a predetermined threshold; and generating a critical alarm in response to determining that the count of the alarm is above the predetermined threshold.

13. The one or more computer-readable storage media of claim 11, wherein:

the isolation valve is a liquid solenoid valve; and the refrigerant is A2L refrigerant.

14. The one or more computer-readable storage media of claim 11, wherein the operations further comprise determining whether a cooling mode of the HVAC system has been locked out, wherein a heating mode of the HVAC system is not locked out due to the detected refrigerant leak.

15. A heating, ventilation, and air conditioning (HVAC) system, comprising:

an indoor unit comprising an indoor blower;

an outdoor unit comprising a compressor and a condenser;

an isolation valve coupled to the outdoor unit;

a sensor operable to detect a leak of refrigerant; and one or more controllers operable to:

generate an alarm in response to the sensor detecting the refrigerant leak;

operate the indoor blower in response to generating the alarm;

close the isolation valve in response to generating the alarm;

operate the compressor to pump down the refrigerant to the condenser in response to generating the alarm;

determine that the alarm has been deactivated;

determine that a cooling mode of the HVAC system has been initiated;

open the isolation valve in response to determining that the cooling mode has been initiated; and generate a second alarm in the event the sensor detects the refrigerant leak after opening the isolation valve.

16. The HVAC system of claim 15, wherein the one or more controllers are further operable to:

increment a count of the alarm by one in response to generating the alarm;

determine that the count of the alarm is above a predetermined threshold; and generate a critical alarm in response to determining that the count of the alarm is above the predetermined threshold.

17. The HVAC system of claim 15, wherein:

the valve is a liquid solenoid valve; and the refrigerant is A2L refrigerant.

18. A method, comprising:

detecting, by a sensor of a heating, ventilation, and air conditioning (HVAC) system, a leak of refrigerant;

generating an alarm in response to the sensor detecting the refrigerant leak;

operating an indoor blower of an indoor unit of the HVAC system in response to generating the alarm;

closing an isolation valve coupled to an outdoor unit of the HVAC system in response to generating the alarm;

operating a compressor of the outdoor unit to pump down the refrigerant to a condenser of the outdoor unit in response to generating the alarm;

determining that the alarm has been deactivated;

determining that a cooling mode of the HVAC system has been initiated;

opening the isolation valve in response to determining that the cooling mode has been initiated; and generating a second alarm in the event the sensor detects the refrigerant leak after opening the isolation valve.

19. The method of claim 18, further comprising:

incrementing a count of the alarm by one in response to generating the alarm;

determining that the count of the alarm is above a predetermined threshold; and generating a critical alarm in response to determining that the count of the alarm is above the predetermined threshold.

20. The method of claim 18, wherein:

the isolation valve is a liquid solenoid valve; and the refrigerant is A2L refrigerant.

21. One or more computer-readable storage media embodying instructions that, when executed by a processor, cause the processor to perform operations comprising:

detecting, by a sensor of a heating, ventilation, and air conditioning (HVAC) system, a leak of refrigerant;

generating an alarm in response to the sensor detecting the refrigerant leak;

operating an indoor blower of an indoor unit of the HVAC system in response to generating the alarm;

closing an isolation valve coupled to an outdoor unit of the HVAC system in response to generating the alarm;

operating a compressor of the outdoor unit to pump down the refrigerant to a condenser of the outdoor unit in response to generating the alarm;

determining that the alarm has been deactivated;

determining that a cooling mode of the HVAC system has been initiated;

opening the isolation valve in response to determining that the cooling mode has been initiated; and generating a second alarm in the event the sensor detects the refrigerant leak after opening the isolation valve.

22. The one or more computer-readable storage media of claim 21, wherein the operations further comprise:

incrementing a count of the alarm by one in response to generating the alarm;

determining that the count of the alarm is above a predetermined threshold; and generating a critical alarm in response to determining that the count of the alarm is above the predetermined threshold.

23. The one or more computer-readable storage media of claim 21, wherein:

the isolation valve is a liquid solenoid valve; and the refrigerant is A2L refrigerant.

* * * * *